US005207438A

United States Patent [19]

Landers

[11] Patent Number: 5,207,438

[45] Date of Patent: May 4, 1993

[54] BRAKE FOR IN LINE SKATE

[76] Inventor: Gary Landers, 97 Grovers Ave., Winthrop, Mass. 02152

[21] Appl. No.: 923,522

[22] Filed: Aug. 3, 1992

Related U.S. Application Data

[62] Division of Ser. No. 803,528, Dec. 9, 1991, abandoned.

[51] Int. Cl.[5] ..... A63C 17/14

[52] U.S. Cl. ..... 280/11.2; 188/5

[58] Field of Search ..... 280/11.19, 11.2, 11.22, 280/11.23, 11.27; 188/2 R, 5

[56] References Cited

U.S. PATENT DOCUMENTS

| | | | |
|---|---|---|---|
| 2,430,037 | 11/1947 | Vincent | 280/11.2 |
| 4,298,209 | 11/1981 | Peters | 280/11.2 |
| 4,379,564 | 4/1983 | Welker | 280/11.2 |
| 5,028,058 | 7/1991 | Olson | 280/11.2 X |

FOREIGN PATENT DOCUMENTS

| | | | |
|---|---|---|---|
| 14276 | of 1909 | United Kingdom | 280/11.2 |
| 20811 | of 1909 | United Kingdom | 280/11.2 |
| 453425 | 9/1936 | United Kingdom | 280/11.22 |

*Primary Examiner*—Margaret A. Focarino
*Assistant Examiner*—Michael Mar
*Attorney, Agent, or Firm*—Testa, Hurwitz & Thibeault

[57] ABSTRACT

A brake structure for an in line skate is mounted on the forward end of the skate. The brake structure comprises two brackets secured to the skate and a rotatable cylinder which rotates in contact with the brackets to produce a frictional braking force when the cylinder is contacted with the ground.

3 Claims, 3 Drawing Sheets

BRAKE FOR IN LINE SKATE

This is a division of co-pending application Ser. No. 07/803,528, filed Dec. 9, 1991, now abandoned.

BACKGROUND OF THE INVENTION

This invention relates to a braking mechanism for recreational boots having rollers and commonly referred to as in line skates.

At the present time recreational in line skates are available which have a boot section adapted to fit over the foot of a user and rollers attached to the boot section. The rollers are aligned in one row rather than two rows as has been the roller arrangement for roller skates. The user of in line skates is able to achieve speeds in excess if about 30 miles per hour on a flat surface which speeds are much faster than can be achieved by the user with roller skates. While these achievable higher speeds provide additional enjoyment to the user, these speeds also present additional danger since there is increased difficulty in stopping. These dangers are particularly acute when the user is required to come to a quick stop due to the presence of an unexpected obstacle or otherwise.

At the present time a braking mechanism is provided for in line skates which is secured to the rear portion of the boot section and which comprises a flat fixed surface. The mechanism is undesirable since it requires the user to thrust his foot forward of his body so that the user is positioned awkwardly and out of balance. In addition, it is difficult for the user to exert high pressure on the fixed surface brake due to the user's leg being thrust forward. As a result, the fixed surface brake will bounce from the ground and it will be rendered ineffective when off the ground. It also has been proposed to use a fixed surface brake on the forward position of a roller skate as is described, for example, in U.S. Pat. No. 4,379,564 and 4,298,209. These fixed surface brakes also are undesirable particularly at the high speeds attainable by the in line skate user since these brakes also will bounce from the ground during use.

Accordingly, it would be desirable to provide a braking system particularly adaptable for use with in line skates which permits its use by the user in a balanced unawkward position. In addition, it would be desirable to provide such a braking system which minimizes or eliminates brake bounce or "chatter" during use.

SUMMARY OF THE INVENTION

The present invention provides a braking system for in line skates which is positioned on the toe portion of the boot section of the in line skate. The brake system comprises a rotatable section having two flat rotatable surfaces and two stationary surfaces on a braket section. The stationary surfaces each are in contact with a rotatable surface. The rotatable surfaces are formed of a material which permits the rotatable section to rotate in contact with the stationary surfaces when used as a brake. Braking is effected by the friction force between the rotatable surfaces and the stationary surfaces.

SUMMARY OF THE INVENTION

Figure 1:
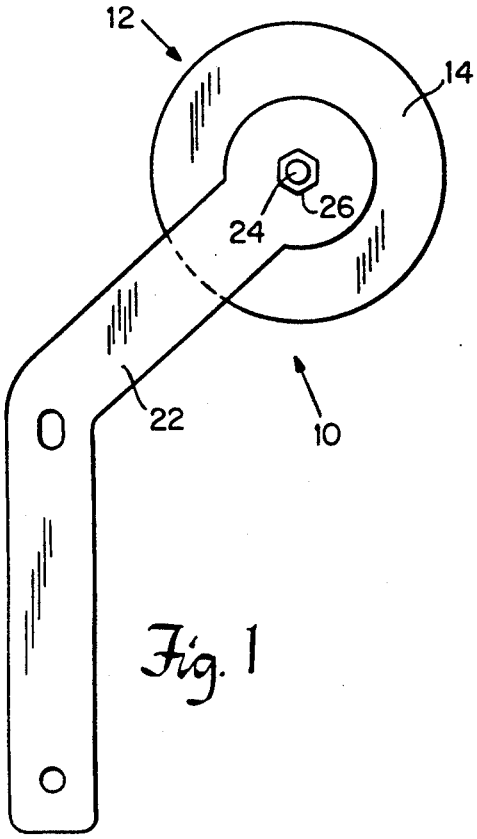
FIG. 1 is a side view of an in line skate brake structure of this invention.

The in line skate brake structure of this invention utilizes a contacting surface having controlled friction characteristics. A rotatable cylinder having two opposing rotatable flat surfaces is mounted within a bracket having flat stationary surfaces in contact with the rotatable flat surfaces. The frictional characteristics of the rotatable flat surface and stationary flat surfaces are controlled so that the cylinder is caused to rotate when it is contacted with the ground by the user of the in line skate when the user is moving. The cylinder rotates in contact with the flat stationary surfaces to produce a frictional force which slows the forward speed of the in line skate. The brake structure is mounted adjacent to the toe portion of the boot. In use, the user extends his foot rearwardly of his body to position the cylinder portion of the brake structure in contact with the ground so that it drags behind the forward moving user. Also, in use, the user lowers his body to attain a more stable position than when standing erect. Since the user is in a more stable position when braking, the brake structure of this invention provides improved safety from falling by the user. In addition, since the braking system is used rearwardly of its user, it can be used as a rudder to control steering and thereby to avoid dangerous objects in the path of the user. Furthermore, rearward application of the brake permits application of larger force to the ground as compared to extending to the user's leg forward of the user. When the friction force between the stationary flat surfaces and the rotatable flat surfaces is too high, the cylinder will not rotate and it will chatter or bounce when contacted with the ground. This is an undesirable result since no braking force will exist when the cylinder is out of contact with the ground and because the braking force will be intermittent. When the frictional force between the rotatable flat surfaces and the stationary flat surfaces are too low, the rotating cylinder will not provide an adequate braking force for the user. It has been found that the friction force can be controlled by controlling the materials forming the rotatable flat surfaces and the stationary flat surfaces. For example, it has been found that a hard rubber, carbon-filled composition such as is commonly found in a hockey puck when treated with a friction reducing agent is suitable for use in the invention. Suitable friction reducing agents include friction reducing polymers such as silicone (polysiloxanes) and polytetrafluoroethylenes which can be applied in a solution to the hard rubber base to be absorbed by the hard rubber. The solvent for these polymers then is evaporated such as by slight heating to leave the friction reducing polymer within the interstices of the relatively porous hard rubber base. Thus when the rotating surfaces of the cylinder is eroded with the friction forces of use, the newly exposed surfaces exhibit the same desired frictional characteristics. The brackets can be formed of metal, e.g. aluminum or a polymeric composition, e.g., polyurethane. The braking structure of this invention can be adjusted according to the needs of the user which can vary according to the weight of the user so that adjustable frictional forces can be effected. The frictional forces can be adjusted by controlling the initial compression force between the stationery flat surfaces and the rotatable flat surfaces. This adjustment can be easily effected by controlling the compression forces with the mounting means for the rotatable flat surface such as a conventional bolt and nut arrangement.

The braking structure of this invention can be utilized with in line skates having a soft boot made from pliable flexible leather or the like or blades having a hard boot made from an inflexible material such as polyurethane compositions or the like. The braking structure can be secured solely to the means for securing the supporting rollers for the boot including the axle for the supporting rollers. Alternatively, the braking structure can be secured to the in line skate by attaching it both to the boot portion of the in line skate and the means for mounting the supporting rollers from the in line skate. In addition, the means for mounting the braking structure of this invention can be adjustable to accommodate varying sized boots for the in line skates.

Figure 2:
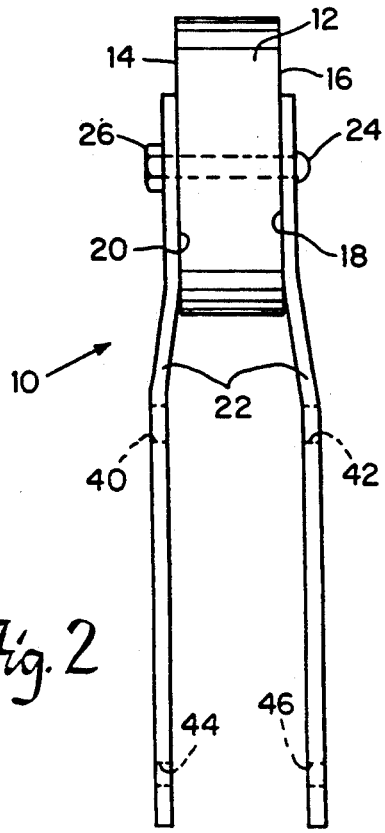
FIG. 2 is a top view of the structure of FIG. 1.
Figure 3:
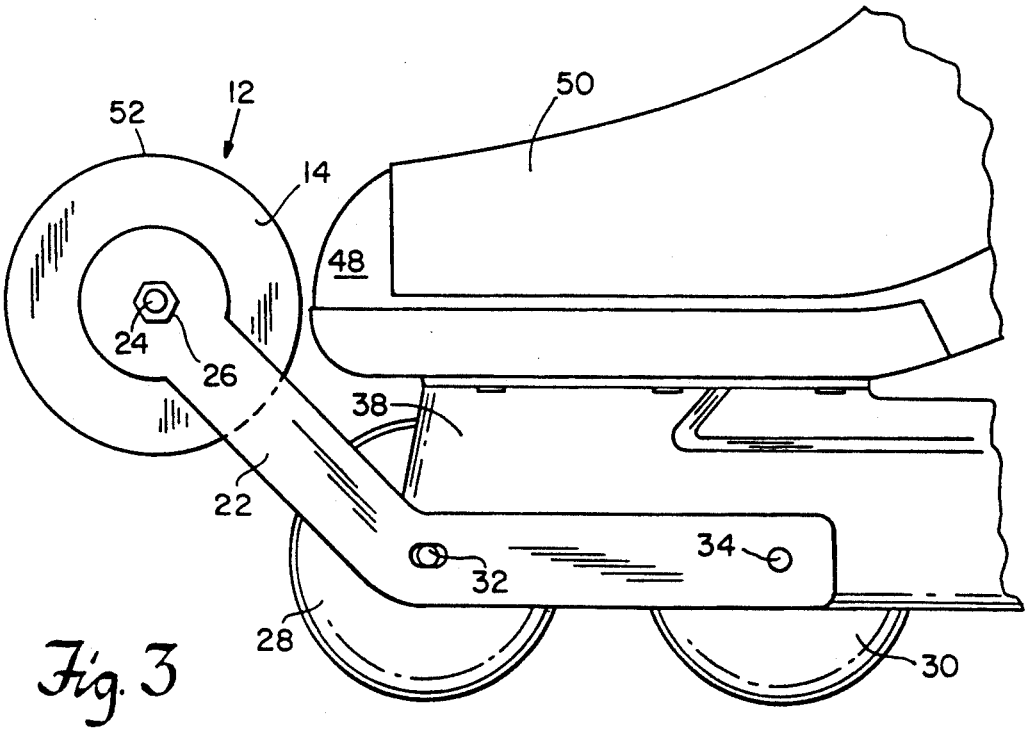
FIG. 3 is a side view of the structure of FIGS. 1 and 2 positioned on an in line skate.
Figure 4:
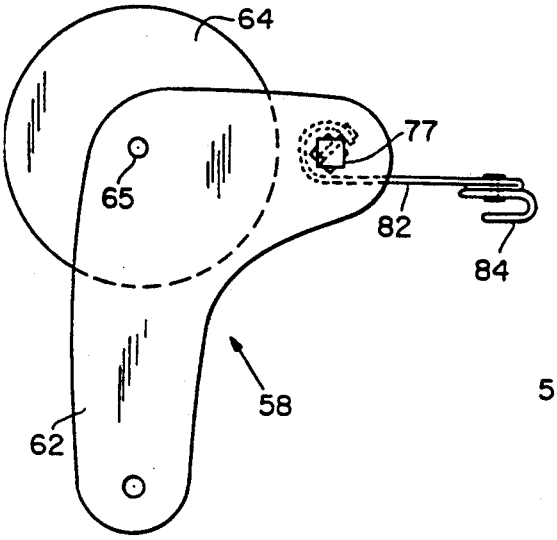
FIG. 4 is a side view of an alternative in line skate brake structure of this invention.
Figure 5:
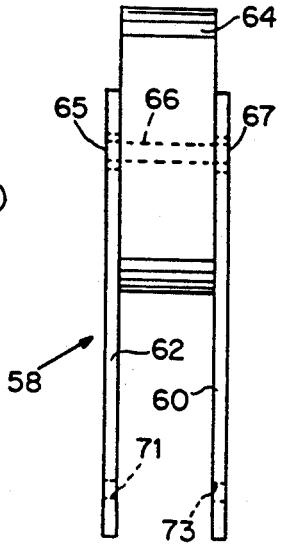
FIG. 5 is a top view of the structure of FIG. 4.
Figure 9:
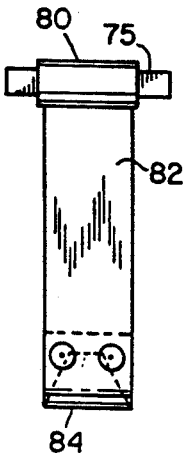
FIG. 9 is a top view of an adjustable strap structure utilizable with the brake structure of FIGS. 4–6.
Figure 6:
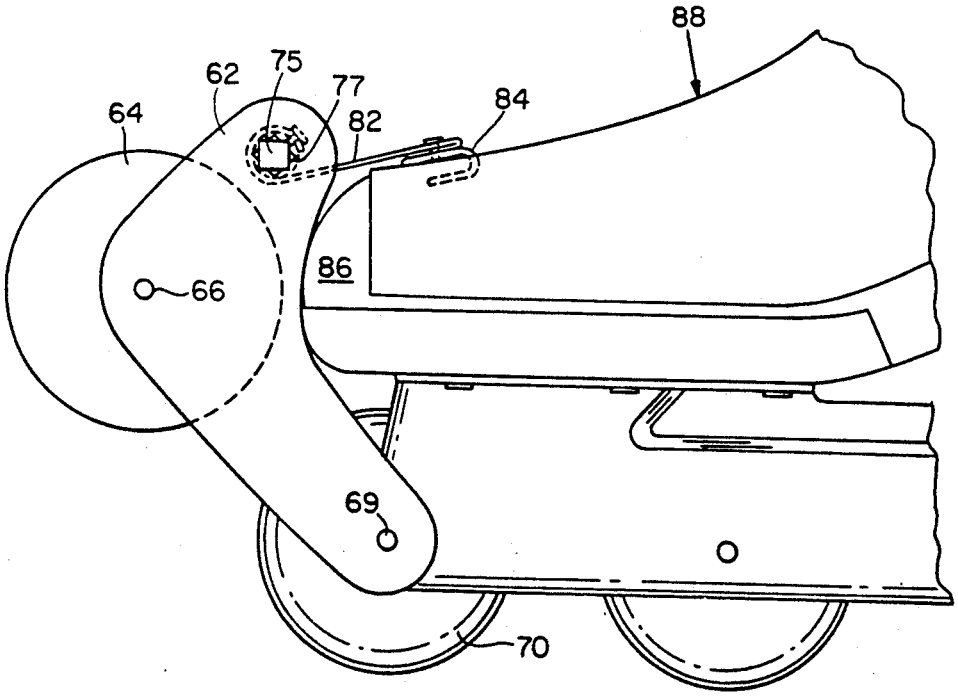
FIG. 6 is a side view of the structure of FIGS. 4 and 5 positioned on an in line skate.

Referring to FIGS. 1-3, the in line skate structure 10 positioned into intimate contact with flat surfaces 18 and comprises a rotatable cylinder 12 having rotatable flat surfaces 14 and 16. The rotatable surfaces 14 and 16 are 20 of bracket 22. The compressive force between surface 20 and surface 14 as well as between surface 16 and surface 18 is controlled by controlling the compressive force effected with bolt 24 and nut 26 or by any other conventional securing or support means for a rotatable cylinder 12. The bracket 22 is mounted on support means for wheels 28 and 30 which are mounted on axles 32 and 34 respectively. The axles are mounted on bracket support 38 by bolts and nuts as is commonly available in the art. The holes 40 and 42 in bracket 22 are aligned with axle 44. The cylinder 12 is positioned adjacent the toe portion 48 of boot 50 mounted on support 38. In use, the forward surface 52 of cylinder 12 is contacted with the ground so as to rotate cylinder 12 and cause friction between surfaces 14 and 20 as well as between surfaces 16 and 18. The frictional forces so-produced exert a braking force on the forwardly moving user to stop the movement of the user. The bracket 22 is mounted on axles 32 and 34 so as to prevent rotation about axle 32 when cylinder 12 contacts the ground.

Referring to FIGS. 4-6 and 9, an adjustable brake structure 58 is shown which includes two brackets 60 and 62 and a rotatable cylinder 64. The cylinder 64 is mounted on axle 66 which can comprise a conventional nut and bolt arrangement extending through holes 65 and 67. One end of each bracket 60 and 62 is mounted on axle 69 which also supports front wheel 70 and which extends through holes 71 and 73. A second end of each bracket 60 and 62 is mounted on axle 75 having a plurality of corners such as four corners as shown which fits in holes 77 in each bracket having more corners, e.g., eight than that of axle 75. Thus, axle 75 can be placed in a plurality of positions within holes 77. The central section 80 of axle 75 is secured to one end of a strap 82 and the second end of the strap is secured to a clip 84 which fits on toe section 86 of boot 88. The length of the strap 82 is adjusted by winding it on axle section 80 to hold the brake structure 52 in place on boots of varying size so that cylinder 64 does not contact the toe section 86 when in use.

Figure 8:
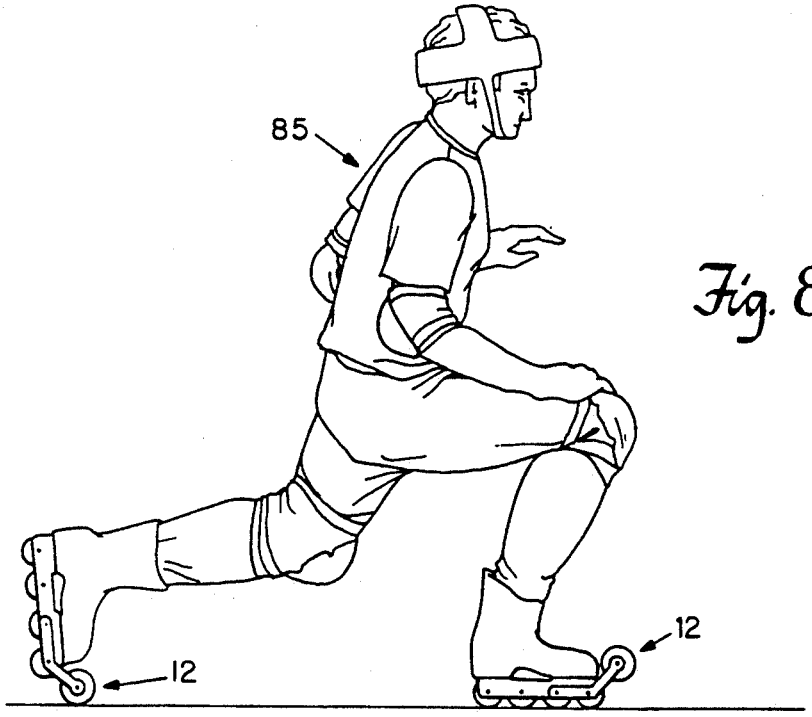
FIG. 8 illustrates the use of the brake structure of this invention.

As shown in FIG. 8, the brake structure 12 or 58 is used by the skater 85 by extending the brake structure rearwardly so that the cylinder section contacts the ground. Since the skater's body is lowered during use of the brake structure, the skater's body is in better balance than when he is erect.

Figure 7:
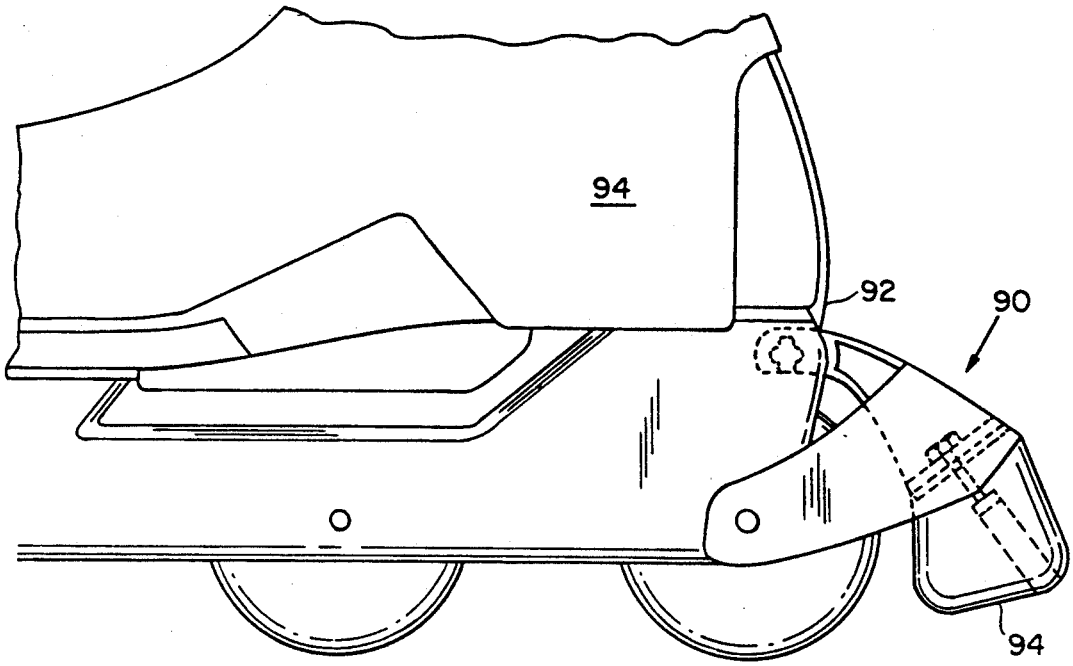
Fig. 7 PRIOR ART
FIG. 7 is a side view of an in line skate structure of the prior art.

In contrast, the brake structure of the prior art is shown in FIG. 7 wherein it is secured to the same section 92 of a boot 94. The brake structure 90 has a flat stationary surface 94 which, in use, contacts the ground. This brake structure must be extended ahead of the moving skater while he is erect. In addition, since the surface 94 is stationary, it will tend to bounce off the ground during use. It is therefore, undesirable.

I claim:

1. Braking system for an in line skate having a boot, a support member fixed to the boot and a plurality of wheels mounted on the support member via axles, the system comprising a pair of parallel, spaced brackets having a lower end pivotably mounted to a forward end of the support member, each of the brackets having a generally planar configuration with opposed inner and outer flat surfaces, a disc-shaped braking member extending transversely between forward portions of the pair of brackets and having substantially flat end surfaces for engaging respective flat inner surfaces of the pair of brackets, means for rotatably mounting the braking member to the brackets and for maintaining frictional contact between the end surfaces of the braking member and the inner surfaces of the brackets, so as to generate a braking force when the braking member is rotated by being placed in ground contact during movement of the skate, an axle extending transversely between upper portions of the brackets, and strap means having a forward end secured to the axle and a rearward end secured to a forward portion of the boot for securing the brackets against a toe portion of the boot, and adjustment means for adjusting the length of the strap means.

2. A braking system for an in-line skate having a boot, a support member fixed to the boot, and a plurality of wheels mounted on the support member via axles, the system comprising a pair of parallel, spaced brackets, each of which has a horizontal lower portion with two holes for receiving wheel-supporting axles of the two foremost wheels of the skate to secure the bracket to the support member, and a forward portion extending forwardly and upwardly from the lower portion, the brackets having a generally planar configuration with opposed flat inner and outer surfaces, a disc-shaped braking member extending transversely between the forward portions of the pair of brackets and having substantially flat end surfaces for engaging respective flat inner surfaces of the pair of brackets, and means for rotatably mounting the braking member to the brackets and for maintaining frictional contact between the end surfaces of the braking member and the inner surfaces of the brackets so as to generate a braking force when the braking member is rotated by being placed in ground contact during movement of the skate.

3. System as set forth in claim 2 wherein the adjustment means includes means for winding the strap means around the axle and for preventing the strap means from becoming unwound.

* * * * *